US010625146B2

(12) United States Patent
Wegner

(10) Patent No.: US 10,625,146 B2
(45) Date of Patent: Apr. 21, 2020

(54) DEVICE FOR SETTING UP A GAME

(71) Applicant: HEADIS GMBH, Weselberg (DE)

(72) Inventor: Rene Wegner, Weselberg (DE)

(73) Assignee: HEADIS GMBH, Weselberg (DE)

( * ) Notice: Subject to any disclaimer, the term of this patent is extended or adjusted under 35 U.S.C. 154(b) by 0 days.

(21) Appl. No.: 16/151,348

(22) Filed: Oct. 4, 2018

(65) Prior Publication Data

US 2019/0105555 A1 Apr. 11, 2019

(30) Foreign Application Priority Data

Oct. 6, 2017 (DE) ..... 10 2017 123 306

(51) Int. Cl.

| | |
|---|---|
| ***A63D 15/00*** | (2006.01) |
| ***A63D 15/06*** | (2006.01) |
| ***A63F 7/00*** | (2006.01) |
| ***A63F 7/30*** | (2006.01) |
| ***A63F 7/34*** | (2006.01) |
| *A63F 7/36* | (2006.01) |

(52) U.S. Cl.

CPC ..... *A63F 7/0023* (2013.01); *A63D 15/003* (2013.01); *A63F 7/305* (2013.01); *A63F 7/3055* (2013.01); *A63F 7/34* (2013.01); *A63F 2007/0047* (2013.01); *A63F 2007/3629* (2013.01); *A63F 2250/18* (2013.01); *A63F 2250/605* (2013.01)

(58) Field of Classification Search

CPC ..... A63D 15/00; A63D 15/045; A63D 15/04; A63F 7/0023; A63F 7/305; A63F 2007/0047; A63B 67/02

USPC ..... 473/7, 6, 4, 13, 14, 19, 20, 28, 31, 32; D21/782

See application file for complete search history.

(56) References Cited

U.S. PATENT DOCUMENTS 83,759 A * 11/1868 Buzby ..... A63D 15/00 473/3
235,861 A * 12/1880 Estephe ..... A63D 15/045 473/7
292,547 A * 1/1884 Dockstader ..... A63D 15/045 473/7

(Continued)

FOREIGN PATENT DOCUMENTS

DE 10 2015 122 817 A1 6/2017
FR 2612795 A1 * 9/1988 ..... A63D 15/045

(Continued)

OTHER PUBLICATIONS

V. Speyerer: "Hesher Ball at Founder's Thursday", Photo of the Game (Apr. 21, 2017).

*Primary Examiner* — Mitra Aryanpour
(74) *Attorney, Agent, or Firm* — Norman B. Thot

(57) ABSTRACT

A device for setting up a game with a ball, the device being reversibly dismountable so that it can be assembled and/or played with anywhere on an existing plate surface. The device includes at least one ball clamping unit with a first side wall, a second side wall, and a ball admission opening which is arranged between the first side wall and the second side wall. The ball is clamped in the at least one ball clamping unit so that the ball remains on the existing plate surface when the ball enters the ball admission opening. The at least one ball clamping unit is detachably fastened to the existing plate surface in an assembled state.

10 Claims, 2 Drawing Sheets

(56) References Cited

U.S. PATENT DOCUMENTS

| | | | | | |
|---|---|---|---|---|---|
| 328,092 | A * | 10/1885 | Waggoner | A63D 15/045 | 473/7 |
| 365,849 | A * | 7/1887 | Nygard | A63D 15/045 | 473/7 |
| 740,012 | A * | 9/1903 | Haskell | A63D 15/045 | 473/7 |
| 747,716 | A | 12/1903 | How | | |
| 767,309 | A * | 8/1904 | McGee | A63D 15/045 | 473/7 |
| 1,190,891 | A | 7/1916 | Harbourt | | |
| 1,894,989 | A * | 1/1933 | Hansen | A63D 15/045 | 473/7 |
| 2,540,729 | A * | 2/1951 | Haskell | A63F 1/06 | 473/13 |
| 3,138,387 | A * | 6/1964 | Michel | A63B 67/02 | 473/159 |
| 3,591,176 | A * | 7/1971 | Roth | A63D 15/00 | 473/3 |
| 4,010,949 | A * | 3/1977 | Lee | A63D 15/045 | 473/7 |
| 4,095,786 | A * | 6/1978 | Foley | A63D 15/045 | 473/7 |
| 4,318,543 | A * | 3/1982 | Vollendorf | A63D 15/045 | 473/7 |
| 4,445,689 | A | 5/1984 | Rainey | | |
| 6,168,533 | B1 * | 1/2001 | Camara | A63B 67/02 | 473/10 |
| D480,775 | S * | 10/2003 | Fischer | D21/782 | |
| 9,162,136 | B1 * | 10/2015 | Towns | A63D 15/00 | 473/4 |

FOREIGN PATENT DOCUMENTS

| | | | |
|---|---|---|---|
| FR | 2692160 | A1 * | 6/1992 |
| GB | 416377 | | 9/1934 |
| WO | WO 03/090885 | A1 | 11/2003 |

* cited by examiner

DEVICE FOR SETTING UP A GAME

CROSS REFERENCE TO PRIOR APPLICATIONS

Priority is claimed to German Patent Application No. DE 10 2017 123 306.7, filed Oct. 6, 2017. The entire disclosure of said application is incorporated by reference herein.

FIELD

The present invention relates to a device for setting up a game, wherein a ball can be assigned to the device, the device is reversibly dismountable and can be assembled and/or played with anywhere on an available plate surface, wherein the device comprises at least one ball clamping unit with a first side wall, a second side wall and a ball admission opening disposed between the two side walls and, in the assembled state, the at least one ball clamping unit is detachably fastened to the available plate surface.

BACKGROUND

With conventional gaming tables, for example, billiard tables or table soccer tables, the respective tables are permanently arranged and installed so that the playing surface is predefined. The disadvantage of these conventional gaming tables is that they are only movable to a limited extent (if at all) because of their weight and size so that they cannot be used in any given place.

Billiard tables in particular have the disadvantage that the balls disappear in center and corner pockets of the table and are channeled back to a collection point via a return system (ball return) on the sides or at the end underneath the playing level of the billiard table. The game thus cannot be continued or started anew immediately after potting a ball. The balls must much rather first be removed from the collection point, which is arranged separately from the playing surface. Balls may also get stuck in the return system of a billiard table.

In addition to holes and/or recesses in the playing surface and/or rails, using collecting receptacles, collecting baskets and/or collecting nets for receiving a rolling ball is known. The disadvantage in all cases is that the "potted" ball must leave the playing surface to be collected, and that a player cannot quickly and directly seize that ball to continue the game. Such ball collecting receptacles, baskets and/or nets also protrude over the playing surface and thus interfere with the players' movements during the game.

SUMMARY

An aspect of the present invention is to improve upon the prior art.

In an embodiment, the present invention provides a device for setting up a game wherein a ball is assignable to the device, and the device is configured to be reversibly dismountable and can be at least one of assembled and played with anywhere on an existing plate surface. The device includes at least one ball clamping unit comprising a first side wall, a second side wall, and a ball admission opening arranged between the first side wall and the second side wall. The ball admission opening is configured so that, when the ball enters the ball admission opening, the ball is clamped in the at least one ball clamping unit so that the ball remains on the existing plate surface. The at least one ball clamping unit is detachably fastened to the existing plate surface in an assembled state.

BRIEF DESCRIPTION OF THE DRAWINGS

The present invention is described in greater detail below on the basis of embodiments and of the drawings in which.

DETAILED DESCRIPTION

Figure 1:
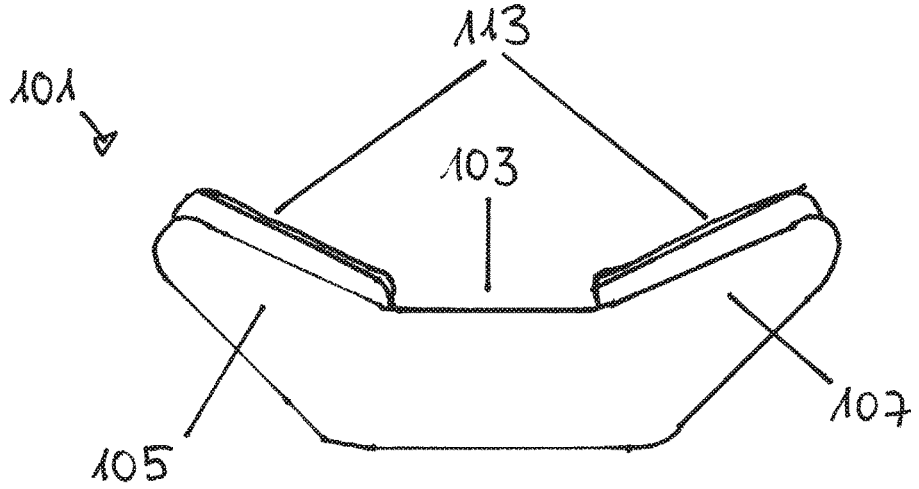
FIG. 1 shows a schematic representation of the upper side of a ball clamping unit.
Figure 2:
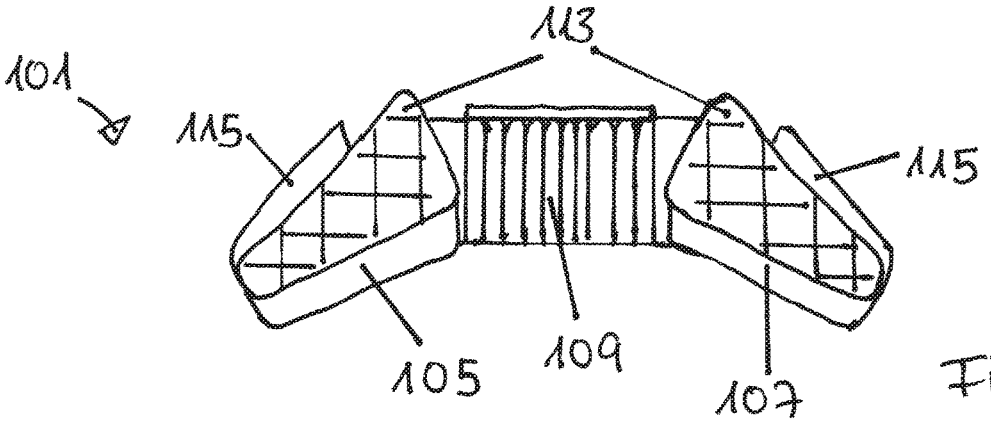
FIG. 2 shows a schematic representation of the lower side of the ball clamping unit.
Figure 3:
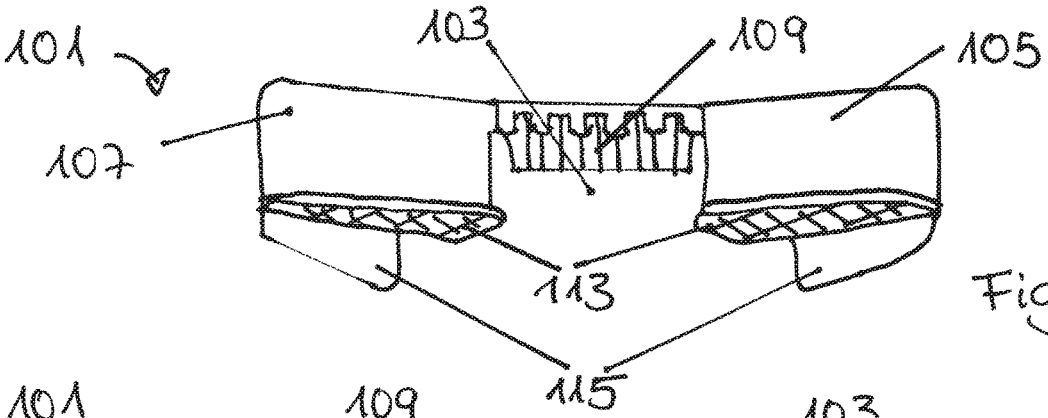
FIG. 3 shows a schematic representation of the front side of the ball clamping unit.
Figure 4:
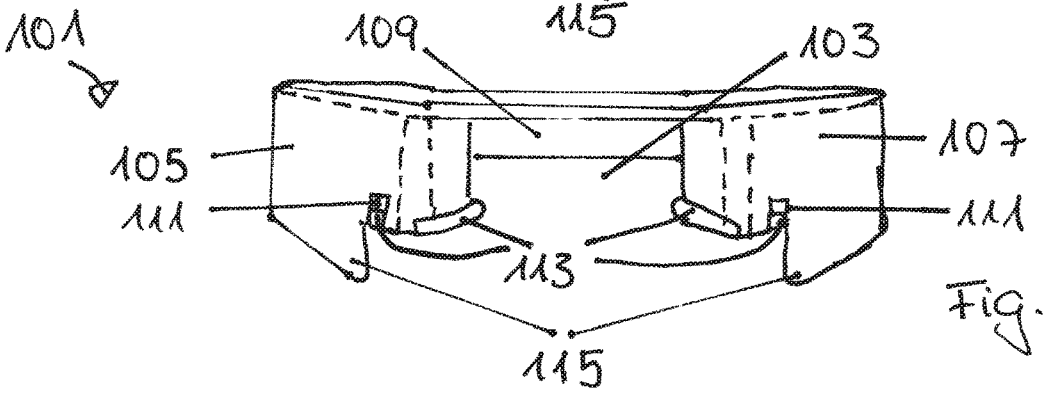
FIG. 4 shows a schematic representation of the rear view of the ball clamping unit.
Figure 5:
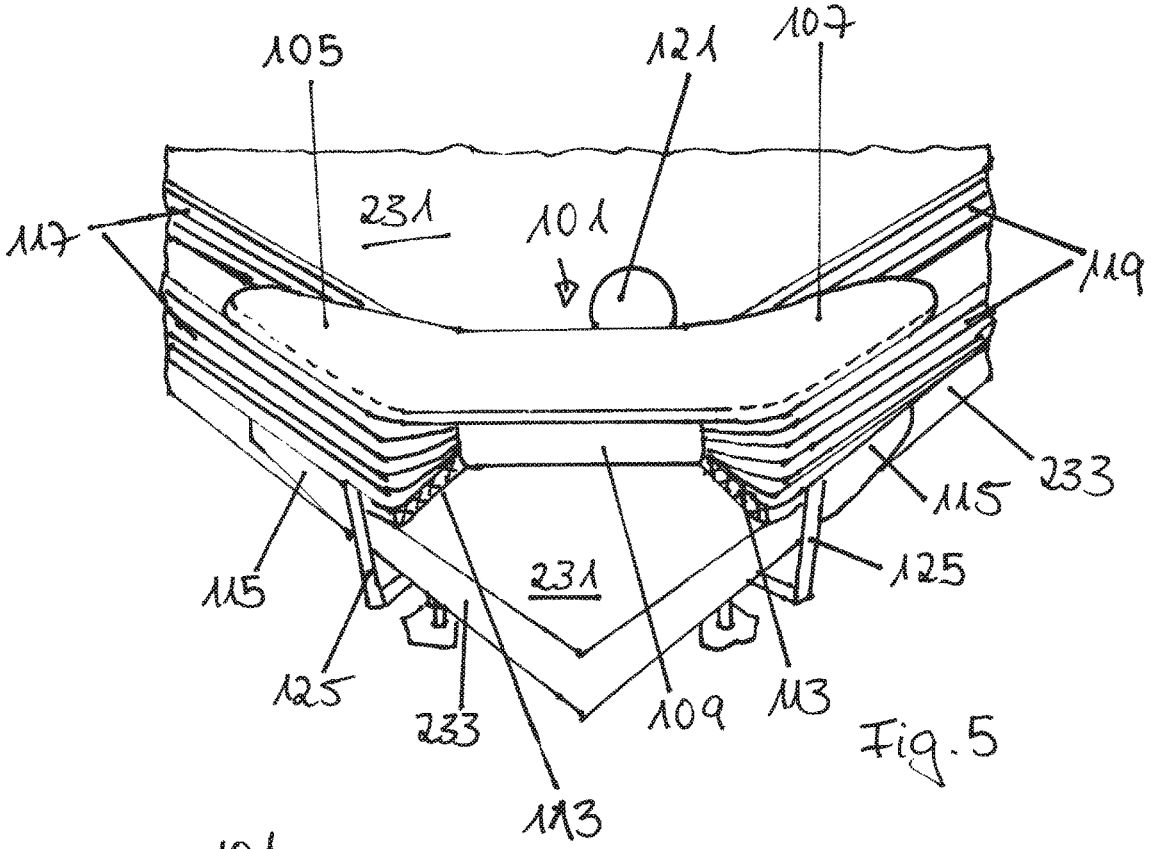
FIG. 5 shows a schematic representation of the ball clamping unit mounted at a corner of a table plate with two rail straps.
Figure 6:
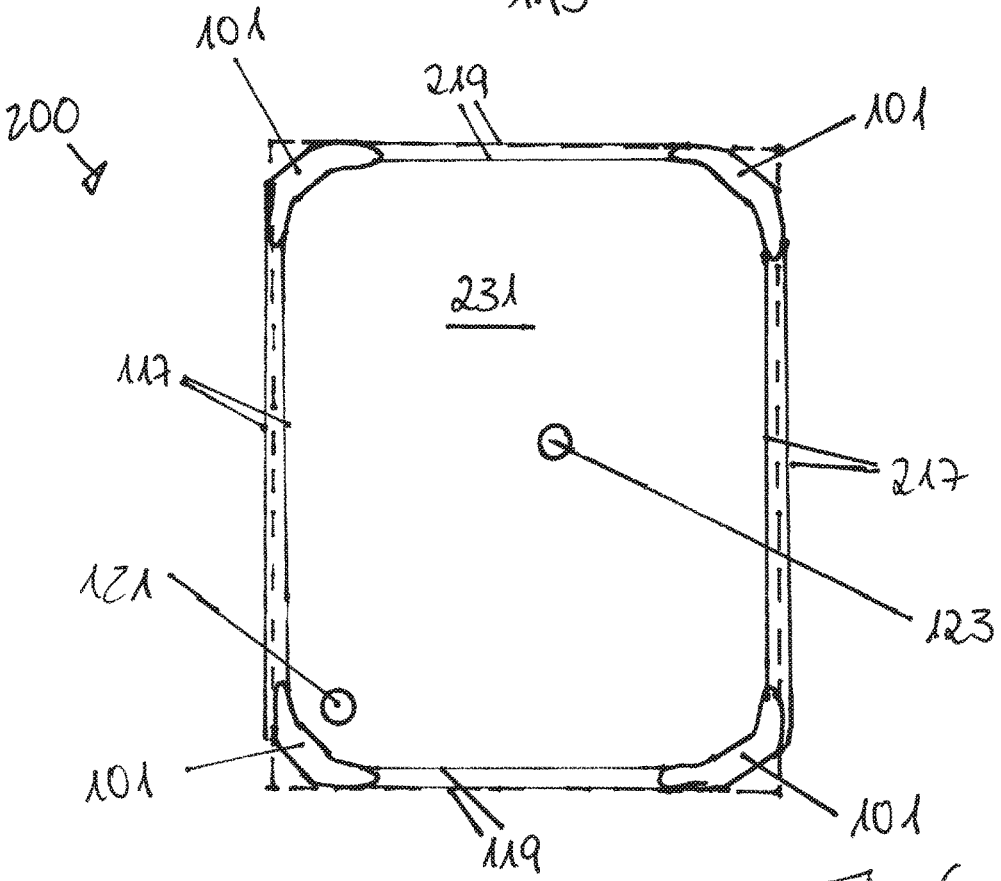
FIG. 6 shows a Hesher-Ball gaming device in a top view with four ball clamping units and four rail straps on the table plate.

An already available plate surface is thus transformed into a playing surface via the device, and a gaming table is set up without requiring permanently installed table components such as holes for receiving the balls.

It is particularly advantageous that, after the ball has rolled into the ball admission opening, the ball is partially or entirely clamped in the ball admission opening and/or inside the ball clamping unit, and thus remains directly on the plate surface. The clamped ball can thus be easily removed by a player from the ball clamping unit directly from the plate surface without any delay.

A key aspect of the present invention is based on the fact that by assembling the reversibly dismountable components of the device on any available plate surface, a playing surface is set up and the potted ball remains on the playing surface via the ball clamping unit so that it can be easily removed by a player, without any delay, to continue the game.

The following terms must be explained:

"Reversible" in particular means that the device for setting up a game can be repeatedly disassembled and reassembled and that the assembly and dismantling processes take place in an essentially non-destructive manner.

A "ball clamping unit" is more specifically a unit which receives, slows down and/or clamps a ball. With the ball clamping unit, the reception and/or clamping of the ball more specifically takes place in the area of and/or on the playing and/or plate surface, so that the ball clamping unit does not substantially protrude beyond the edges of the plate surface. A ball clamping unit is more specifically fastened within the plate surface at a corner of the plate surface. The ball clamping unit can, however, also be mounted and/or disposed in any position along the outer edge of a plate and/or table surface. The ball clamping unit more specifically comprises metal and/or a synthetic material. The ball clamping unit itself can be reversibly dismountable into several components.

The (game) ball can be more specifically covered with a fabric such as velour or designed in a rubber-like manner to avoid scratching the table surface.

A "plate surface" is more specifically an even component whose dimensions forming the horizontal surface are greater than its vertical dimension. The plate surface is more specifically an even and/or horizontal surface. A plate surface can be more specifically a table, one or several pieces of beer garden furniture, a ping-pong table or another type of plane. The plate surface can more specifically consist of any solid material.

The term "playing surface" refers more specifically to the surface used for playing. The playing surface is in particular limited by the components of the device. The playing surface is in particular defined by arranging at least one ball clamping unit on an available plate surface. The playing surface can in this regard in particular have the same size or be smaller than the plate surface. The playing surface can also be defined by a ball clamping unit and a rail strap or several rail straps and/or several ball clamping units and several rail straps. When a single ball clamping unit is used on the plate surface, the playing surface can be defined by the extension of the two side walls of the ball clamping unit. It is particularly advantageous in this regard if each side wall has a length in the range of 3 cm to 1.5 m, in particular 5 cm to 1 m, for example, 7.5 cm to 25 cm.

A "rail strap" is more specifically an enclosure and/or boundary of a playing surface. A rail strap is more specifically a strap of flexible length or a rail that is solid and/or a rail that can be wound up and/or a stand-alone rail. The rail strap is more specifically tensioned around and/or between the components of the device, in particular around and/or between the ball clamping units. The rail strap in particular borders the inner playing surface and/or prevents tokens and/or balls from falling off the playing surface. The rail strap also more specifically borders the outer plate surface.

A "clamping guide" is more specifically a component of the ball clamping unit which slows down and/or clamps a ball entering the ball admission opening. A clamping guide more specifically causes a narrowing of the free space at and/or after the ball admission opening. To this end, the clamping guide inside the ball clamping unit can, for example, have an increasing material thickness as the distance from the ball admission opening increases so that the free space provided for the ball inside the ball clamping unit becomes narrower as the ball moves further inward. The clamping guide can more specifically have elastic and/or resilient clamping elements therefor.

A "retainer for a clamping device" more specifically refers to an engagement and/or contact element for a clamping device. A retainer can, for example, be an admission opening in a side wall with which a clamping device, such as a clamp with a jaw, engages. A retainer can also have a different shape and/or be an element of the ball clamping unit with which the clamping means engages.

A "clamping device" is more specifically a device for solidly and reversibly fastening the ball clamping unit to the plate surface. A clamping device can, for example, be a clamp, such as a bar clamp, a cam clamp and/or a spring clamp.

In one alternative, the ball clamping unit does not feature a retainer for a clamping device and is not fixed to the plate surface via a clamping device. The inside of the two side walls is rather respectively filled with a heavy material, for example, lead balls, so that once it has been set down on a plate surface, the ball clamping unit remains in position on the plate surface because of its weight, even during a game and/or upon entry of a ball.

It is particularly advantageous if the first side wall and/or the second side wall of the ball clamping unit is or are respectively shaped on the side of the ball admission opening so that a rail strap can be led around the side wall. A separate fastening of a rail strap to the ball clamping unit can thus be dispensed with.

A "non-slip covering" is more specifically a covering which is disposed on the bottom side of the side walls of the ball clamping unit and thus on a side contacting the plate surface and which reduces and/or prevents the ball clamping unit from slipping on the plate surface. A non-slip covering can, for example, be a felt covering, a synthetic material, a foam material, rubber and/or the like.

The ball clamping unit comprises an edge abutment in order to further prevent a slipping of the ball clamping unit and to help secure the ball clamping unit to the plate surface via the clamping device. The ball clamping unit is thus not only disposed on the plate surface, but also laterally encloses an edge of the plate surface by way of the edge abutment.

A "releasable fastener" is more specifically a fastening device that can be closed and released as often as desired. A releasable fastener is in particular a hook-and-loop fastener, a clasp, a coupling fastener, hooks and/or D-rings.

A "hook-and-loop fastener" is more specifically a predominantly textile quick fastener that can be reversibly released and closed as often as desired. A hook-and-loop fastener in particular consists of two woven chemical fiber straps, wherein, more specifically, one strap comprises flexible barbed hooks and the other strap comprises loops. A hook-and-loop fastener is in particular made of woven hook-and-loop straps, such as polyamide, polyester, polyolefin and/or polyaramid fibers.

A playing surface can thus be flexibly set up on an available plate surface and/or fitted to the available plate surface depending on the number and the arrangement of the ball clamping units and/or the rail straps.

It is particularly advantageous if, in the assembled state, a ball clamping unit is disposed at each corner of the available plate surface and the rail straps are tensioned between the ball clamping units around the respective side walls of the ball clamping units along the outer boundaries and/or edges of the plate surface so that the playing surface essentially corresponds to the plate surface. Because the ball clamping unit essentially does not protrude beyond the plate surface, it does not hinder the movements of the players and thus does not impede the flow of the game.

The present invention also provides a transport device, in particular a backpack, which receives a dismountable device for setting up a game and comprises a shoulder strap, wherein the dismountable device is a previously described device.

It is particularly advantageous in this regard if the carried device for setting up a game weighs less than 15 kg, for example, less than 10 kg, and in particular less than 5 kg.

The present invention will be described in more detail below based on exemplary embodiments.

A Hesher-Ball gaming device 200 comprises four ball clamping units 101 which are reversibly fastened above a corner of a table plate 231. The Hesher-B all gaming device 200 further comprises a first rail strap 117, a second rail strap 119, a third rail strap 217, and a fourth rail strap 219. Each rail strap 117, 119, 217, 219 respectively connects one side wall 105 or 107 of the respective ball clamping unit 101 along a respective table edge 233 with a corresponding opposite side wall 105 or 107 of the opposite ball clamping unit 101. Each rail strap 117, 119, 217, 219 thus forms an inner boundary and an outer boundary of a playing surface, wherein all the components of the Hesher-B all gaming device 200 are substantially disposed within the table plate 231.

A ball clamping unit 101 comprises a central ball admission opening 103, a left side wall 105, and a right side wall 107 (in a top view onto the upper side). The side walls 105 and 107 respectively comprise a non-slip covering 113 on their bottom side. Each side wall 105 and 107 further respectively comprises one edge abutment 115, which is respectively disposed at the rear. At the rear, the left side wall 105 and the right side wall 107 also respectively comprise one clamp retainer 111 located on the inside next to the respective edge abutment 115.

The Hesher-B all gaming device 200 can be transported to the location of the table plate 231 via a backpack. The four ball clamping units 101 are then mounted at the corners of the table plate 231. To this end, the ball clamping unit 101 is placed on the table plate 231 so that the side walls 105 and 107 are vertically flush with the table edges 233 of the table plate 231, wherein the respective edge abutment 115 of the left side wall 105 and the right side wall 107 abut on the corresponding table edge 233 of the table plate 231 from the outside. The ball clamping unit 101 is then clamped to the table plate 231 via two clamps 125, wherein a respective upper jaw of the clamp 125 engages with the clamp retainer 111 of the left side wall 105 and the right side wall 107 and a corresponding lower jaw of each clamp 125 is disposed underneath the table plate 231 so that the ball clamping unit 101 is detachably fastened to the table plate 231 by tightening each clamp 125 via a screw.

At the ball clamping unit 101, which is disposed in the left bottom corner of the table plate 231 in a top view of the table plate 231, the first rail strap 117 is led around the left side wall 105 and doubly pulled along the table edge 233 to the top left ball clamping unit 101 in a top view and correspondingly led around its right side wall 107. The first rail strap 117 is closed under tension on the outside of the outer side (with respect to the bounded playing surface) via a hook-and-loop fastener (not shown in the drawings). This can also be carried out via a buckle. The second rail strap 119 is similarly led around the right side wall of the ball clamping unit 101, which is disposed in the bottom left corner in a top view of the table plate 231, and similarly around the left side wall 105 of the ball clamping unit 101, which is disposed in the bottom right corner of the table plate 231 in a top view of the table plate 231, and is also closed under tension in the center on the outside via a hook-and-loop fastener (not shown in the drawings). All four ball clamping units 101 and rail straps 117, 119, 217 and 219 are respectively mounted on the table plate 231 as described above.

A bounded playing surface is thus set up, the size of which essentially corresponds to that of the table plate 231 as a result of the four ball clamping units 101 disposed on the table plate 231.

When using the Hesher-B all gaming device, the red billiard ball 121 (or alternately the red ball) and the black billiard ball 123 (alternately the black ball) are played by hand. Guiding and tensioning the rail straps 117, 119, 217 and 219 around the respective side walls 105 and 107 prevents the rail straps 117, 119, 217 and 219 from being pushed back when the billiard ball 121 or 123 rolls against them and the billiard balls 121 and 123 from falling off the table plate 231.

The red billiard ball 121 is rolled by a player in the direction of the ball clamping unit 101, which is located in the bottom left corner in a top view of the table plate 231. The red billiard ball 121 enters the ball admission opening 103 and is slowed down by the clamping guide 109 inside the ball clamping unit 101 on the upper side so that the red billiard ball 121 comes to a halt on the table plate 231 serving as a playing surface. The player then immediately removes the red billiard ball 121 from the ball clamping unit 101 through the ball admission opening 103 and directly resumes the game on the playing surface.

After the game, the Hesher-Ball gaming device 200 is removed from the table plate 231 and transported, in the backpack, as individual components, to a new playing site.

The present invention is not limited to embodiments described herein; reference should be had to the appended claims.

LIST OF REFERENCE NUMBERS

101 ball clamping unit
103 ball admission opening
105 left side wall
107 right side wall
109 clamping guide
111 clamp retainer
113 non-slip covering
115 edge abutment
117 first rail strap
119 second rail strap
121 red billiard ball
123 black billiard ball
125 clamp
200 Hesher-ball gaming device
217 third rail strap
219 fourth rail strap
231 table plate
233 table edge

What is claimed is:

1. A device for setting up a game,
wherein,
a ball is assignable to the device, and
the device is configured to be reversibly dismountable and can be at least one of assembled and played with anywhere on an existing plate surface,
the device comprising:
at least one ball clamping unit comprising a first side wall, a second side wall, and a ball admission opening arranged between the first side wall and the second side wall, the ball admission opening being configured so that, when the ball enters the ball admission opening, the ball is clamped in the at least one ball clamping unit so that the ball remains on the existing plate surface;
at least one rail strap; and
at least one of:
a plurality of ball clamping units comprising two ball clamping units, three ball clamping units, four ball clamping units, or more than four ball clamping units, and
a plurality of rail straps comprising two rail straps, three rail straps, four rail straps or more than four rail straps,
wherein,
the at least one ball clamping unit is detachably fastened to the existing plate surface in an assembled state, and
the at least one rail strap or the plurality of rail straps can be at least one of,
tensioned around at least one of the first side wall and the second side wall, and fastened to at least one of the first side wall and the second side wall, of the at least one ball clamping unit or of the plurality of ball clamping units.

2. The device as recited in claim 1, wherein the ball admission opening comprises a clamping guide on an inside, the clamping guide being configured so that the ball, when entering the device, is slowed down and clamped.

3. The device as recited in claim 1, wherein the at least one ball clamping unit, the at least one rail strap, and the existing plate surface provide a bounded playing surface.

4. The device as recited in claim 1, wherein at least one of the first side wall and the second side wall of the at least one ball clamping unit comprises or of the plurality of ball clamping units each comprise a retainer for a clamping device, the retainer being configured so that the at least one ball clamping unit or the plurality of ball clamping units can be clamped to the existing plate surface.

5. The device as recited in claim 4, wherein the existing plate surface is a table.

6. The device as recited in claim 1, wherein at least one of the first side wall and the second side wall of the at least one ball clamping unit comprises or of the plurality of ball clamping units comprise a non-slip covering on a side which contacts the existing plate surface.

7. The device as recited in claim 1, wherein, at least one of the first side wall and the second side wall of the at least one ball clamping unit comprises or of the plurality of ball clamping units comprise an edge abutment, and the edge abutment is configured so that the at least one ball clamping unit rests or the plurality of ball clamping units rest laterally against an edge of the existing plate surface.

8. The device as recited in claim 1, wherein the at least one rail strap comprises or the plurality of rail straps comprise a releasable fastener.

9. The device as recited in claim 8, wherein the releasable fastener is a hook-and-loop fastener.

10. The device as recited in claim 1, wherein, in the assembled state, the bounded playing surface can be set up within the existing plate surface in at least one of a variable manner and an adjustable manner to the existing plate surface by positioning the at least one ball clamping unit or the plurality of ball clamping units and the at least one rail strap or the plurality of rail straps on the existing plate surface.

* * * * *